US006058944A

United States Patent [19]

Porter

[11] Patent Number: 6,058,944

[45] Date of Patent: May 9, 2000

[54] COMBUSTION HEATED HAIR DRYER

[76] Inventor: Katherine Porter, 54 Perry Place Dr., Pontiac, Mich. 48340

[21] Appl. No.: 09/270,435

[22] Filed: Mar. 16, 1999

[51] Int. Cl.[7] ..... A45D 19/16

[52] U.S. Cl. ..... 132/272; 132/212; 34/97; 34/96; 126/404

[58] Field of Search ..... 132/212, 272, 132/206; 34/97, 96, 98, 100; 431/344; 126/404, 407, 409, 414

[56] References Cited

U.S. PATENT DOCUMENTS

| | | | |
|---|---|---|---|
| 3,377,715 | 4/1968 | Hubner | 34/99 |
| 4,121,353 | 10/1978 | Baumgartner et al. | 34/99 |
| 4,361,966 | 12/1982 | Downey | 34/99 |
| 4,662,084 | 5/1987 | Maass | 34/99 |
| 4,995,171 | 2/1991 | Yoshinaga et al. | 34/97 |
| 5,009,592 | 4/1991 | Roldan et al. | 431/344 |
| 5,608,975 | 3/1997 | Hsu | 34/97 |
| 5,651,190 | 7/1997 | Sanders | 34/99 |
| 5,787,601 | 8/1998 | Stelly | 34/99 |
| 5,857,262 | 1/1999 | Bonnema et al. | 34/97 |

*Primary Examiner*—Gene Mancene
*Assistant Examiner*—Pedro Philogene
*Attorney, Agent, or Firm*—Joseph N. Breaux

[57] ABSTRACT

A portable hair dryer that utilizes portable stove and portable grill sized propane tanks to supply fuel to a heat exchanger including a gas burner. The discharge vent of the heat exchanger includes a flame arrester screen at least three inches form the outer edge thereof.

1 Claim, 2 Drawing Sheets

COMBUSTION HEATED HAIR DRYER

TECHNICAL FIELD

The present invention relates to portable hair dryers and more particularly to a combustion heated hair dryer that includes a heater unit housing, a heater unit carrying strap attached to the heater unit housing, a propane cylinder connection fitting provided within the heater unit housing, a heat exchange burner positioned within a heat exchanger compartment contained within the heater unit housing, a heat exchanger burner on/off valve in gas flow controlling connection between the propane cylinder connection fitting and the heat exchange burner, a burner air intake vent tube having a first end in connection with the exterior of the heater unit housing and a second end adjacent to and in air supplying connection with a venturi tube air inlet positioned between the heat exchanger burner on/off valve and the heat exchange burner, a burner air discharge vent having a flame arrester screen positioned therein a distance of at least three inches from the terminal end of the burner air discharge vent, a blower having a blower air intake vent in connection with the exterior of the heater unit housing, a blower speed controller in controlling connection with the blower motor, a blower heat exchange tube positioned within the heat exchanger compartment above the heat exchange burner and having a heat exchange tube inlet in connection with the blower air outlet, a blower heated air discharge tube in connection with the outlet of the heat exchange tube and terminating in connection with the dryer cap hose connecting opening, a piezo electric burner starter positioned within the heat exchanger compartment adjacent to the heat exchange burner and having a piezo electric burner starter button positioned on the exterior of burner unit housing, and a flexible dryer cap hose having a heater unit housing connecting fitting mateable with the dryer cap hose connecting opening and a second end permanently secured to a flexible dryer cap with an elastic retaining band.

BACKGROUND ART

It is often desirable to have a hair dryer that can be used while walking around performing other activities. Although it is desirable to have such a portable hair dryer, it is difficult to provide sufficient heating power to supply the hair dryer without heavy and expensive batteries. It would be a benefit, therefore, to have a portable hair dryer that utilized a heating generating mechanism that did not require batteries.

GENERAL SUMMARY DISCUSSION OF INVENTION

It is thus an object of the invention to provide a combustion heated hair dryer that includes a heating generating mechanism that did not require batteries.

It is a further object of the invention to provide a combustion heated hair dryer that includes a heater unit housing, a heater unit carrying strap attached to the heater unit housing, a propane cylinder connection fitting provided within the heater unit housing, a heat exchange burner positioned within a heat exchanger compartment contained within the heater unit housing, a heat exchanger burner on/off valve in gas flow controlling connection between the propane cylinder connection fitting and the heat exchange burner, a burner air intake vent tube having a first end in connection with the exterior of the heater unit housing and a second end adjacent to and in air supplying connection with a venturi tube air inlet positioned between the heat exchanger burner on/off valve and the heat exchange burner, a burner air discharge vent having a flame arrester screen positioned therein a distance of at least three inches from the terminal end of the burner air discharge vent, a blower having a blower air intake vent in connection with the exterior of the heater unit housing, a blower speed controller in controlling connection with the blower motor, a blower heat exchange tube positioned within the heat exchanger compartment above the heat exchange burner and having a heat exchange tube inlet in connection with the blower air outlet, a blower heated air discharge tube in connection with the outlet of the heat exchange tube and terminating in connection with the dryer cap hose connecting opening, a piezo electric burner starter positioned within the heat exchanger compartment adjacent to the heat exchange burner and having a piezo electric burner starter button positioned on the exterior of burner unit housing, and a flexible dryer cap hose having a heater unit housing connecting fitting mateable with the dryer cap hose connecting opening and a second end permanently secured to a flexible dryer cap with an elastic retaining band.

It is a still further object of the invention to provide a combustion heated hair dryer that accomplishes all or some of the above objects in combination.

Accordingly, a combustion heated hair dryer is provided. The combustion heated hair dryer includes a heater unit housing, a heater unit carrying strap attached to the heater unit housing, a propane cylinder connection fitting provided within the heater unit housing, a heat exchange burner positioned within a heal exchanger compartment contained within the heater unit housing, a heat exchanger burner on/off valve in gas flow controlling connection between the propane cylinder connection fitting and the heat exchange burner, a burner air intake vent tube having a first end in connection with the exterior of the heater unit housing and a second end adjacent to and in air supplying connection with a venturi tube air inlet positioned between the heat exchanger burner on/off valve and the heat exchange burner, a burner air discharge vent having a flame arrester screen positioned therein a distance of at least three inches from the terminal end of the burner air discharge vent, a blower having a blower air intake vent in connection with the exterior of the heater unit housing, a blower speed controller in controlling connection with the blower motor, a blower heat exchange tube positioned within the heat exchanger compartment above the heat exchange burner ano having a heat exchange tube inlet in connection with the blower air outlet, a blower heated air discharge tube in connection with the outlet of the heat exchange tube and terminating in connection with the dryer cap hose connecting opening, a piezo electric burner starter positioned within the heat exchanger compartment adjacent to the heat exchange burner and having a piezo electric burner starter button positioned on the exterior of burner unit housing, and a flexible dryer cap hose having a heater unit housing connecting fitting mateable with the dryer cap hose connecting opening and a second end permanently secured to a flexible dryer cap with an elastic retaining band.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
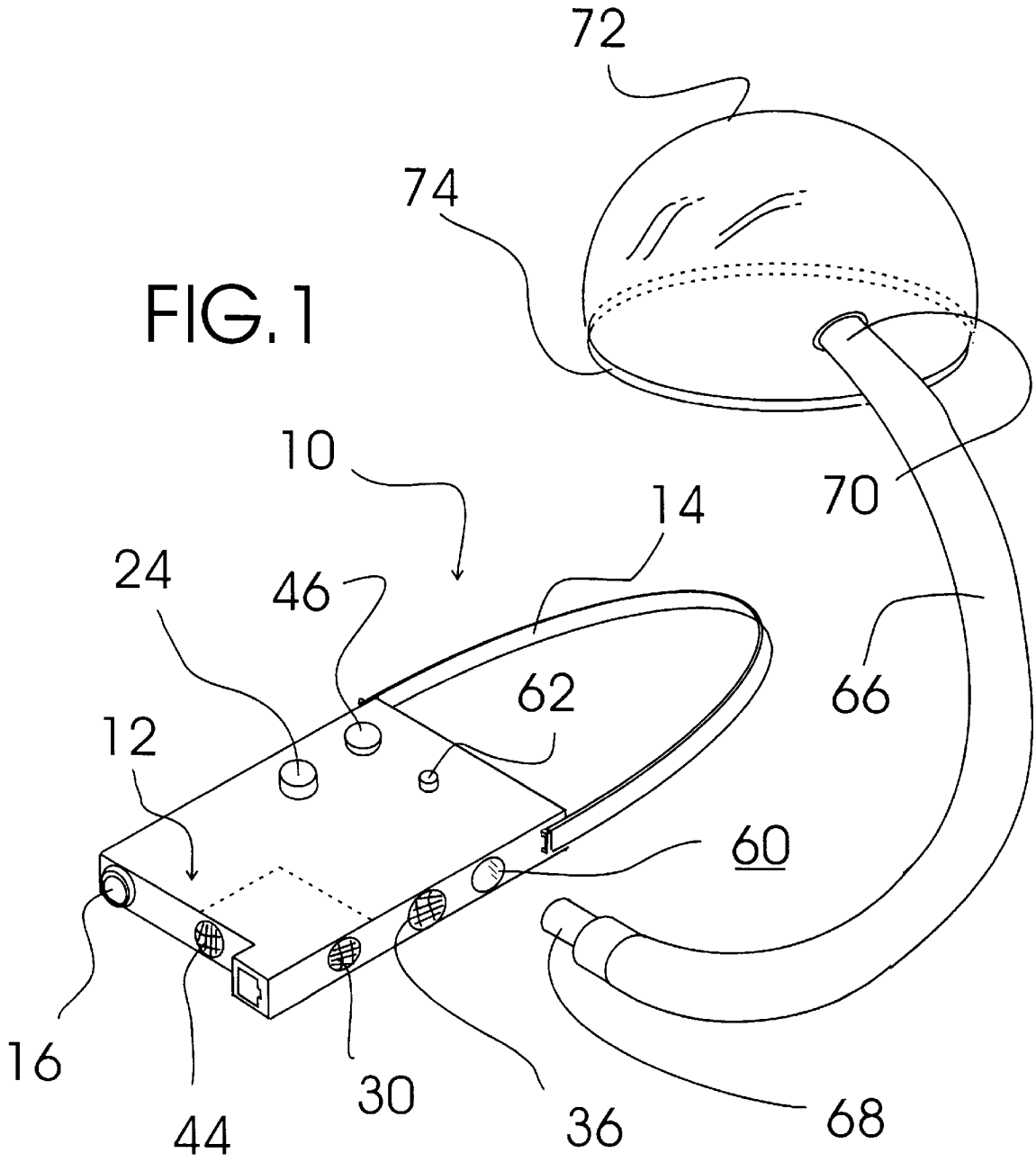
FIG. 1 is a perspective view of an exemplary embodiment of the combustion heated hair dryer of the present invention showing the heater unit housing, the heater unit carrying strap, the replaceable propane cylinder screwed into the heater unit housing, the burner on/off valve, the piezo electric burner starter button, the burner air intake vent, the burner air discharge vent, the battery compartment cover, the blower intake vent, the blower heated air discharge and dryer cap hose connecting opening, the dryer cap hose, arid the dryer cap.

FIG. 1 shows an exemplary embodiment of the combustion heated hair dryer of the present invention generally designated 10. Combustion heated hair dryer 10 includes a metal heater unit housing 12; a heater unit carrying strap 14; a replaceable propane cylinder 16 that is screwable into heater unit housing 12; referring now to FIG. 2, a propane cylinder connection fitting 18 provided within the heater unit housing; a heat exchange burner 20 positioned within a heat exchanger compartment 22 contained within the heater unit housing; a heat exchanger burner on/off valve 24 in gas flow controlling connection between propane cylinder connection fitting 18 and heat exchange burner 20; a burner air intake vent tube 26 having a first end 30 in connection with the exterior of the heater unit housing and a second end 32 adjacent to and in air supplying connection with a venturi tube air inlet 34 positioned between heat exchanger burner on/off valve 24 and heat exchange burner 20; a burner air discharge vent 36 having a flame arrester screen 38 positioned therein a distance "A" of at least three inches from the terminal end 40 thereof; a blower 42 having a blower air intake vent 44 in connection with the exterior of the heater unit housing; a blower speed controller 46 in controlling connection with the blower motor; a blower heat exchange tube 50 positioned within the heat exchanger compartment 22 above heat exchange burner 20 and having a heat exchange tube inlet 52 in connection with a blower air outlet 54; a blower heated air discharge tube 56 in connection with an outlet 58 of heat exchange tube 50 and terminating in connection with a dryer cap hose connecting opening 60; a piezo electric burner starter 62 positioned within heat exchanger compartment 22 adjacent to heat exchange burner 20 and having a piezo electric burner starter button 62 positioned on the exterior of burner unit housing; and, referring back to FIG. 1, a flexible dryer cap hose 66 having a heater unit housing connecting fitting 68 mateable with dryer cap hose connecting opening 60 and a second end 70 permanently secured to a flexible dryer cap 72 having an elastic retaining band 74.

Figure 2:
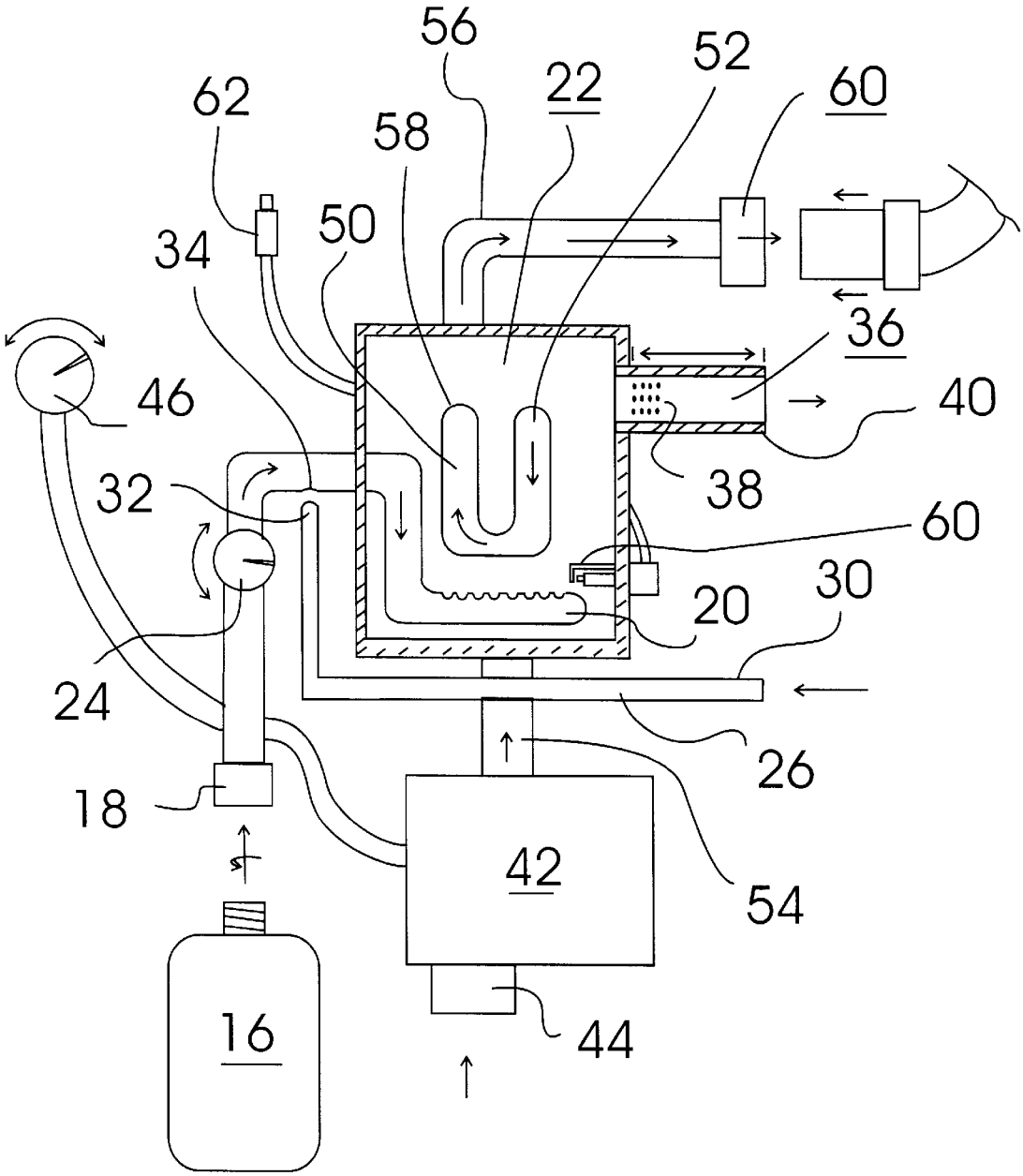
FIG. 2 is a schematic diagram of the combustion heated hair dryer of FIG. 1 showing the replaceable propane cylinder, propane cylinder connection fitting, the heat exchanger burner on/off valve, the burner air intake vent, the heat exchange burner positioned within the heat exchanger compartment, the burner air discharge vent, the three flame arrester screens positioned within the burner air discharge vent, the blower air intake vent, the blower, the blower speed control, the blower heat exchange tube positioned within the heat exchanger compartment above the heat exchange burner having a heat exchange tube inlet in connection with the blower air outlet, the blower heated air discharge in connection with the outlet of the heat exchange tube and terminating in connection with the dryer cap hose connecting opening.

With general reference now to FIGS. 1 and 2, hair dryer 10 is started by installing a propane tank 16, opening heat exchanger burner on/off valve 24 to supply gas and air to heat exchange burner 20, (air is sucked in through burner air intake vent tube 26) and then igniting heat exchange burner 20 by depressing piezo electric burner starter button 62 to activate piezo electric burner starter 62. Once heat exchange burner 20 is lit, blower 42 is activated by adjusting blower speed controller 46 to the desired speed setting, connecting flexile dryer cap hose 66 to heater unit housing 12 by inserting heater unit housing connecting fitting 68 into dryer cap hose connecting opening 60, and then placing flexible dryer cap 72 over the head of the user.

It can be seen from the preceding description that a combustion heated hair dryer has been provided that includes a heat generating mechanism that does not use batteries and that includes a heater unit housing, a heater unit carrying strap attached to the heater unit housing, a propane cylinder connection fitting provided within the heater unit housing, a heat exchange burner positioned within a heat exchanger compartment contained within the heater unit housing, a heat exchanger burner on/off valve in gas flow controlling connection between the propane cylinder connection fitting and the heat exchange burner, a burner air intake vent tube having a first end in connection with the exterior of the heater unit housing and a second end adjacent to and in air supplying connection with a venturi tube air inlet positioned between the heat exchanger burner on/off valve and the heat exchange burner, a burner air discharge vent having a flame arrester screen positioned therein a distance of at least three inches from the terminal end of the burner air discharge vent, a blower having a blower air intake vent in connection with the exterior of the heater unit housing, a blower speed controller in controlling connection with the blower motor, a blower heat exchange tube positioned within the heat exchanger compartment above the heat exchange burner and having a heat exchange tube inlet in connection with the blower air outlet, a blower heated air discharge tube in connection with the outlet of the heat exchange tube and terminating in connection with the dryer cap hose connecting opening, a piezo electric burner starter positioned within the heat exchanger compartment adjacent to the heat exchange burner and having a piezo electric burner starter button positioned on the exterior of burner unit housing, and a flexible dryer cap hose having a heater unit housing connecting fitting mateable with the dryer cap hose connecting opening and a second end permanently secured to a flexible dryer cap with an elastic retaining band.

It is noted that the embodiment of the combustion heated hair dryer described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A combustion heated hair dryer comprising:

a heater unit housing;

a heater unit carrying strap attached to the heater unit housing;

a propane cylinder connection fitting provided within the heater unit housing;

a heat exchange burner positioned within a heat exchanger compartment contained within the heater unit housing;

a heat exchanger burner on/off valve in gas flow controlling connection between the propane cylinder connection fitting and the heat exchange burner;

a burner air intake vent tube having a first end in connection with the exterior of the heater unit housing and a second end adjacent to and in air supplying connection with a venturi tube air inlet positioned between the heat exchanger burner on/off valve and the heat exchange burner;

a burner air discharge vent having a flame arrester screen positioned therein a distance of at least three inches from the terminal end of the burner air discharge vent;

a blower having a blower air intake vent in connection with the exterior of the heater unit housing;

blower speed controller in controlling connection with the blower motor;

a blower heat exchange tube positioned within the heat exchanger compartment above the heat exchange burner and having a heat exchange tube inlet in connection with the blower air outlet;

a blower heated air discharge tube in connection with the outlet of the heat exchange tube and terminating in connection with the dryer cap hose connecting opening;

a piezo electric burner starter positioned within the heat exchanger compartment adjacent to the heat exchange burner and having a piezo electric burner starter button positioned on the exterior of burner unit housing; and a flexible dryer cap hose having a heater unit housing connecting fitting mateable with the dryer cap hose connecting opening and a second end permanently secured to a flexible dryer cap with an elastic retaining band.

* * * * *